US009369807B2

(12) United States Patent
Jiang et al.

(10) Patent No.: US 9,369,807 B2
(45) Date of Patent: Jun. 14, 2016

(54) ELECTROACOUSTIC TRANSDUCER AND MANUFACTURING METHOD THEREOF

(71) Applicant: GOERTEK INC., WeiFang (CN)

(72) Inventors: Chao Jiang, Weifang (CN); Qing Miao, Weifang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 14/411,085

(22) PCT Filed: Sep. 20, 2012

(86) PCT No.: PCT/CN2012/081703

§ 371 (c)(1),
(2) Date: Dec. 23, 2014

(87) PCT Pub. No.: WO2014/000343

PCT Pub. Date: Jan. 3, 2014

(65) Prior Publication Data

US 2015/0181344 A1 Jun. 25, 2015

(30) Foreign Application Priority Data

Jun. 27, 2012 (CN) ..... 2012 1 0215212

(51) Int. Cl.

*H04R 9/04* (2006.01)
*H04R 31/00* (2006.01)
*H04R 9/02* (2006.01)

(52) U.S. Cl.

CPC ..... *H04R 9/046* (2013.01); *H04R 31/006* (2013.01); *H04R 9/02* (2013.01); *H04R 2400/11* (2013.01)

(58) Field of Classification Search

CPC ..... H04R 31/006; H04R 9/046; H04R 9/06; H04R 9/02; H04R 2400/11; H04R 2400/00; H04R 2499/11; Y10T 29/4908; H04M 1/035
USPC ..... 381/400, 395, 393, 396, 409, 332, 386, 381/433
See application file for complete search history.

(56) References Cited

U.S. PATENT DOCUMENTS

| | | | | |
|---|---|---|---|---|
| 6,035,052 | A | 3/2000 | Fujihira et al. | |
| 6,751,334 | B2 * | 6/2004 | Hakansson | H04R 9/025 381/152 |
| 8,989,428 | B2 * | 3/2015 | Hill | H04R 1/06 381/386 |
| 2010/0080406 | A1 * | 4/2010 | Yang | H04R 9/025 381/186 |
| 2012/0114136 | A1 * | 5/2012 | Horigome | H04R 9/02 381/86 |

FOREIGN PATENT DOCUMENTS

| | | | | |
|---|---|---|---|---|
| CN | 101630711 A | | 1/2010 | |
| CN | 101841750 | * | 5/2010 | H04R 1/00 |
| CN | 101841750 | * | 9/2010 | H04R 1/00 |
| CN | 101841750 A | | 9/2010 | |
| CN | 202043153 U | | 11/2011 | |
| JP | 2003173845 A | * | 6/2003 | H01R 13/642 |

OTHER PUBLICATIONS

International Search Report for PCT/CN2012/081703 mailed Mar. 28, 2013.

* cited by examiner

*Primary Examiner* — Davetta W Goins
*Assistant Examiner* — Oyesola C Ojo

(57) ABSTRACT

An electroacoustic transducer comprises flexible strips and a shell, wherein the shell is formed of a first sub shell which is fixedly bonded to a second sub shell, the first sub shell is provided with a bonding surface for being bonded to the second sub shell, the flexible strip is bent to form a bent portion at the bonding surface; the second sub shell is provided with a dodging structure for dodging the bent portion. Its manufacturing method comprises: performing injection molding on the first sub shell from the bonding portions of the elastic strips; performing injection molding on the second sub shell; fixedly bonding the first sub shell with the second sub shell, wherein the flexible strip is bent to form the bent portion from the bonding surface at the end part of the first sub shell.

20 Claims, 3 Drawing Sheets

ELECTROACOUSTIC TRANSDUCER AND MANUFACTURING METHOD THEREOF

TECHNICAL FIELD

The present invention relates to the electroacoustic field, particularly to an electroacoustic transducer and manufacturing method thereof.

BACKGROUND

In the prior art, flexible strips and the shell of an electroacoustic transducer are mainly bonded by snap-fitting or injection-molding. However, when the flexible strips and the shell are bonded by snap-fitting, the flexible strips can be easily deflected, the bonding is insecure, and the assembling process is complicated. If the flexible strips and the shell are bonded by injection molding, the assembling process is simple and the bonding is stable.

With regard to the structure that the flexible strips and the shell are bonded by injection molding, in the prior art, the material of the flexible strips are shaped into strip-shaped elements, and then the joint portion of the flexible strip is bonded to the shell by injection molding, where the joint portion is the portion bonded to the shell on the flexible strip, and after being bonded, one end of the flexible strip is exposed from the edge of the shell, then the flexible strip is bent from the edge of shell to form the bent portion of the flexible strip, which bent portion is able to be flexibly deformed, enabling the flexible strip to be electrically connected with circuitry of the final product.

However, in the existing structure, the bent portion has a certain curvature radius after the flexible strip is bent from the edge and thus projects beyond the edge of the shell inevitably, which increases the volume of the electroacoustic transducer and wastes the space of the final product when the electroacoustic transducer is assembled into the final product, thus adverse to the miniaturization of the final product. Thus, there is a demand for improving the electroacoustic transducer with such a structure to eliminate the above defects.

SUMMARY

In order to solve the above technical problem, the present invention provides an electroacoustic transducer and manufacturing method thereof, which saves the mounting space occupied by the electroacoustic transducer, and is contributive to the miniaturization of the final product.

In order to achieve the above objective, the present invention provides an electroacoustic transducer comprising a flexible strip and a shell, the flexible strip being used for electrically connecting internal circuitry with external circuitry of the electroacoustic transducer, wherein the shell is ring-shaped and comprises a first sub shell and a second sub shell which are fixedly bonded to each other; a part of the flexible strip is bonded to the first sub shell by injection molding, the first sub shell is provided with a bonding surface at its one end close to the second sub shell which bonding surface is used for being bonded to the second sub shell, the flexible strip projects above the bonding surface and is bent at the bonding surface to form the bent portion; and the second sub shell is provided with a dodging structure at a position corresponding to the bent portion which dodging structure is used for dodging the bent portion, and the bent portion is inside the edge of the shell.

In addition, it is preferable that the first sub shell and the second sub shell form a step-shaped dodging structure at the bonding surface.

In addition, it is preferable that the first sub shell is provided with a first end face extending in horizontal direction at the part close to the bonding surface, the second sub shell is provided with a second end face extending in horizontal direction at the part close to the bonding surface, and the horizontal plane in which the first end face is located is higher than the horizontal plane in which the second end face is located; and the bent portion is located above the second end face.

In addition, it is preferable that the flexible strip comprises a joint portion, a deforming portion and a free end portion, wherein the joint portion is used for fixedly bonding the flexible strip with the shell, the deforming portion is connected with the joint portion, and the free end portion is located at the end of the deforming portion.

In addition, it is preferable that a pad is provided at the end of the joint portion, and is exposed out of the inner side surface of the shell.

A manufacturing method of the above electroacoustic transducer comprises the following steps:

a first step of positioning a strip-shaped flexible strip formed by stamping, and injecting sizing material at a position where the flexible strip is bonded with the first sub shell to be formed, so as to form the first sub shell;

a second step of injection molding the second sub shell; and a third step of fixedly integrating the first sub shell with the second sub shell to form a ring-shaped shell;

wherein the strip-shaped flexible strip is bent to form the bent portion from the bonding surface at the end of the first sub shell before the third step.

In addition, it is preferable that the first sub shell and the second sub shell are fixedly bonded at the bonding surface by gluing or ultrasonic welding.

In addition, it is preferable that the first sub shell and the second sub shell are fixedly bonded at the bonding surface by snap-fitting or heat-melting.

Compared with the conventional structure, with the above technical solution of the present invention, the flexible strip is bonded to the first sub shell by injection molding and bent, and then the first sub shell is bonded to the second sub shell. Thus, the electroacoustic transducer and manufacturing method thereof have the advantages that the occupied space of the flexible strip can be effectively controlled, therefore, the mounting space occupied is saved when the electroacoustic transducer is assembled into a final product, and the miniaturization of the final product is achieved.

In order to achieve the above and related objectives, one or more aspects of the present invention comprise the features detailed below and indicated particularly in the claims. Some exemplary aspects of the present invention are described in details by the description below and the accompanying drawings. However, these aspects only indicate some implementations of various implementations of the present invention. In addition, the present invention is intended to contain these aspects and the equivalents thereof

BRIEF DESCRIPTION OF THE DRAWINGS

By referring to the descriptions of the accompanying drawings and the claims, and with a full understanding of the present invention, other purposes and results of the present invention will be more clearly and easily understood. In the drawings:

Similar signs in all figures indicate similar or corresponding features or functions.

DETAILED DESCRIPTION

Various specific details are set forth in the following description to comprehensively understand one or more embodiments for sake of illustration. However, it is obvious that these embodiments can be implemented without such specific details. In other examples, known structures and devices are shown in block diagrams to facilitate describing one or more embodiments.

Particular embodiments of the present invention are described in connection with the accompanying drawings.

Figure 1:
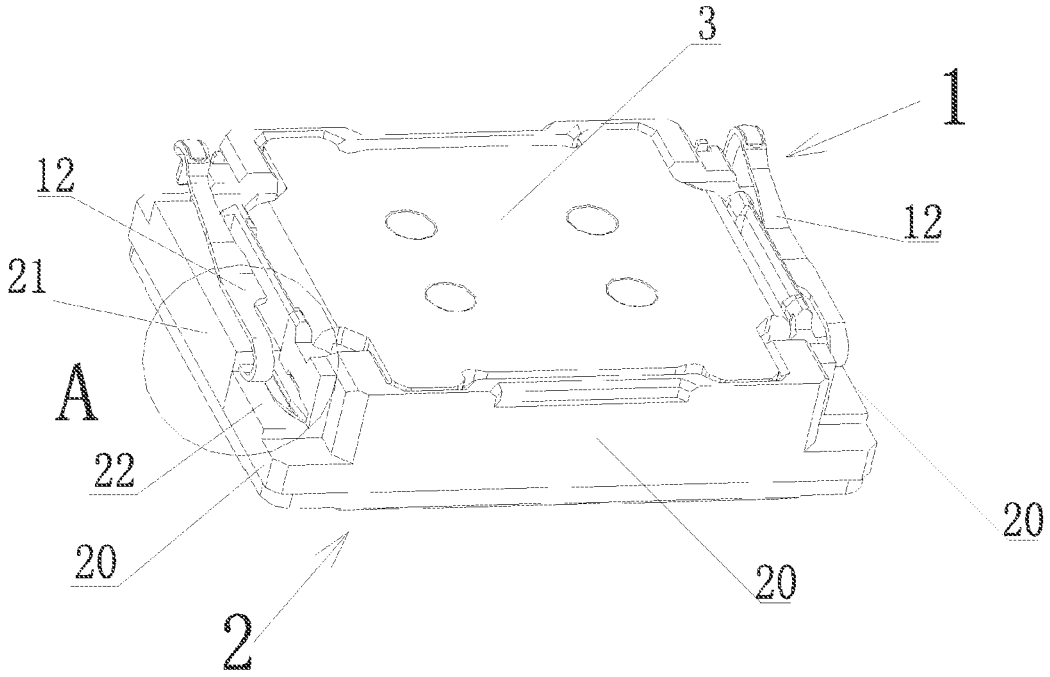
FIG. 1 is a schematic view illustrating the 3D structure of the electroacoustic transducer according to the present invention.
Figure 2:
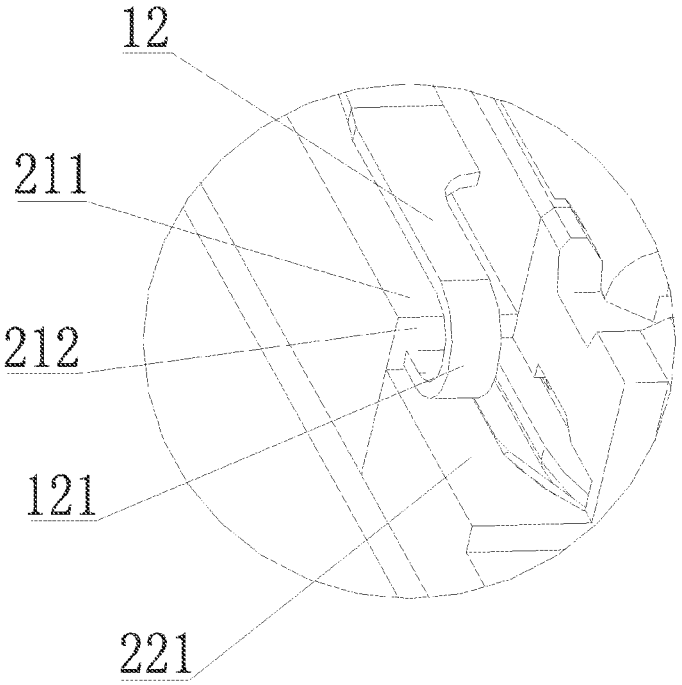
FIG. 2 is an enlarged schematic structure view of part A shown in FIG. 1.

FIG. 1 and FIG. 2 are schematic views illustrating the 3D structure of the electroacoustic transducer according to the embodiments of the present invention. As illustrated in FIG. 1 and FIG. 2, the electroacoustic transducer comprises a vibration system, a magnetic circuit system and a shell 2 for accommodating and fixing the vibration system and the magnetic circuit system, wherein the shell 2 is ring-shaped; and the vibration system comprises a vibrating diaphragm and a voice coil bonded to one side of the vibrating diaphragm close to the magnetic circuit system, the magnetic circuit system comprises a washer, a magnet and a frame 3 that are sequentially combined together, and the magnetic circuit system forms a magnetic gap for accommodating the voice coil. In addition, the electroacoustic transducer further comprises flexible strips 1 bonded to the shell 2, and the flexible strip 1 is used for electrically connecting internal circuitry with external circuitry of the electroacoustic transducer.

In the present embodiment, the flexible strips 1 are bonded to the bottom of the shell 2 and the flexible strip 1 is provided with a deforming portion 12 which deforming portion 12 is able to be flexibly deformed and electrically connected with external circuitry. In the present embodiment, the deforming portion 12 is positioned at the same side of the shell 2 as the bottom wall of the frame 3. However, the present invention is not limited to this.

In the present embodiment, the shell 2 is formed in a manner that a first sub shell 21 is fixedly bonded to a second sub shell 22, and a part of the flexible strip 1 is bonded to the first sub shell 21 by injection molding, the first sub shell 21 is provided with a bonding surface 212 at the end that is close to and bonded to the second sub shell 22, the flexible strip 1 projects from the bonding surface 212 and is bent to form a bent portion 121, and the second sub shell 22 provides a dodging space for the bent portion 121.

In the present embodiment, a stepped structure is formed at the bonding surface 212 by the first sub shell 21 and the second sub shell 22. As illustrated in FIG. 1 and FIG. 2, the first sub shell 21 is provided with a first end face 211 extending in horizontal direction at the position close to the bonding surface 212, the second sub shell 22 is provided with a second end face 221 extending in horizontal direction at the position close to the bonding surface 212, and the horizontal plane in which the first end face 211 is located is higher than the horizontal plane in which the second end face 221 is located. With such a structure, the flexible strip 1 projects from the relative upper part of the bonding surface 212, and the bent portion 121 is located above the second end face 221, thereby providing the dodging space for the bent portions 121 of the flexible strips 1. As illustrated in FIG. 1, after the flexible strips 1 are bent, the bent portions 121 are inside the edge 20 of the shell 2.

It is noted that the dodging structures are not limited to the above structure, as long as the flexible strips 1 are able to be bent from the bonding surface 212.

Figure 3:
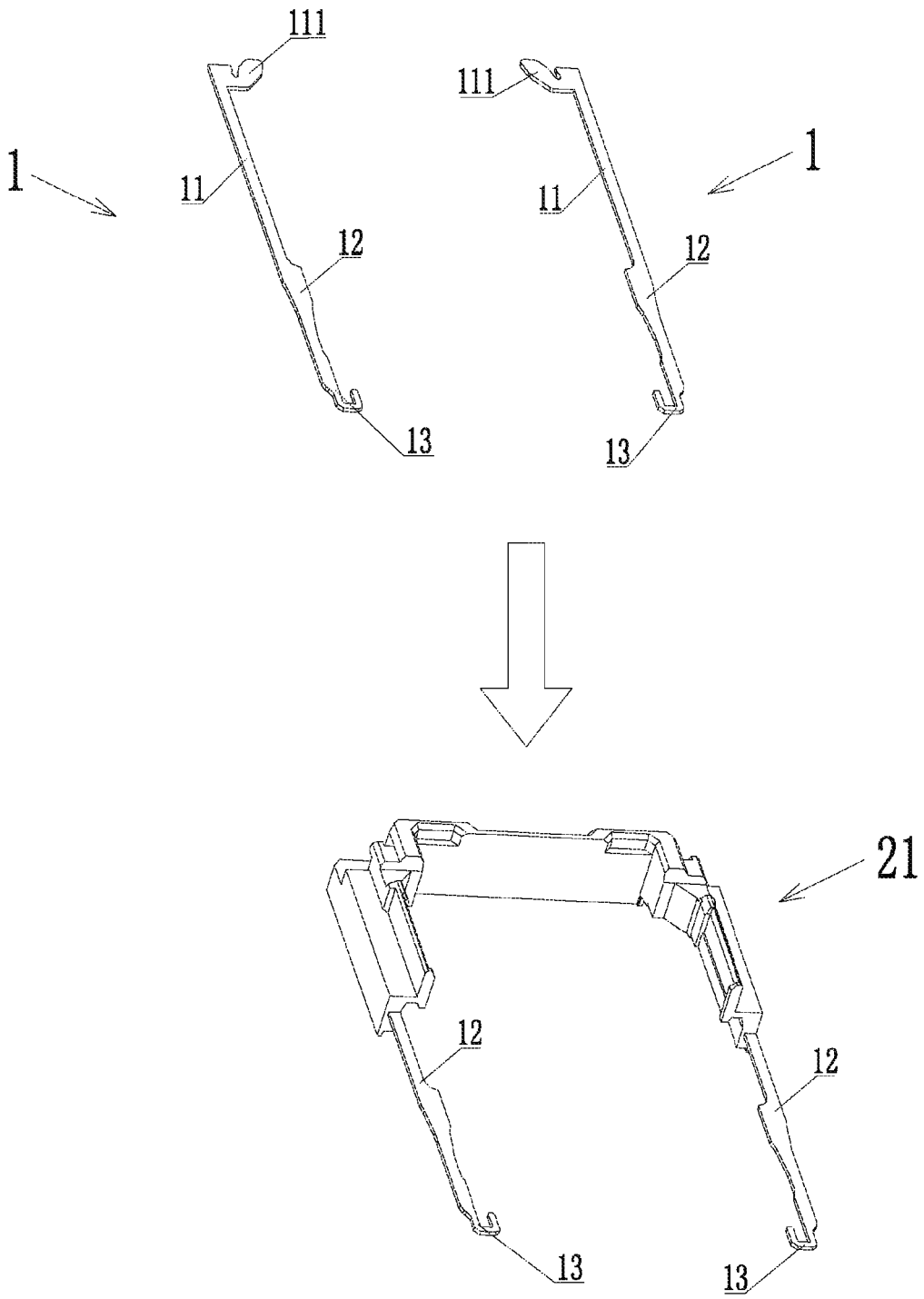
FIG. 3 is a schematic structure view illustrating the first step of the manufacturing method of the electroacoustic transducer according to the present invention.
Figure 4:
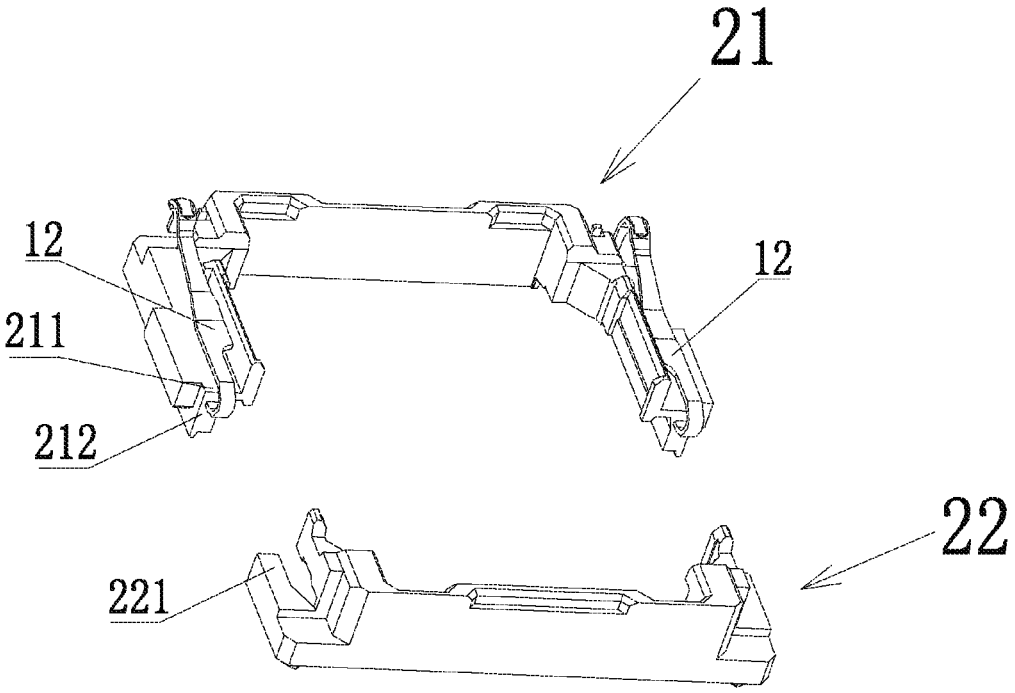
FIG. 4 is a schematic structure view illustrating the second step of the manufacturing method of the electroacoustic transducer according to the present invention.
Figure 5:
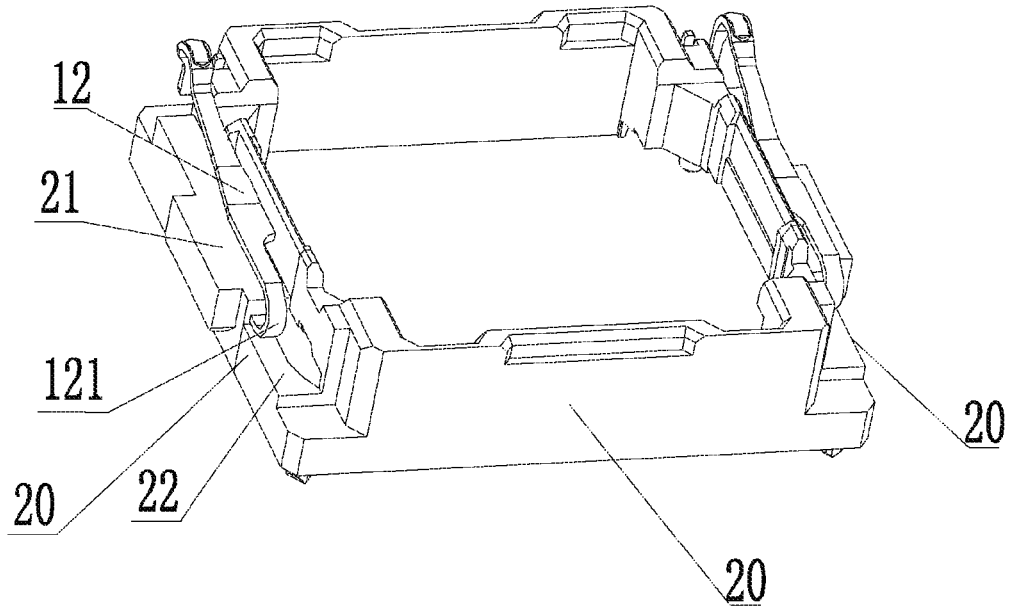
FIG. 5 is a schematic view illustrating the 3D structure of the shell after being assembled with the flexible strips according to the present invention.

FIG. 3 to FIG. 5 are schematic views of assembly structures illustrating the manufacturing method of the electroacoustic transducer according to the present invention. As illustrated in FIG. 3, the flexible strip 1 comprises: a joint portion 11 for being fixedly bonded to the shell 2, a deforming portion 12 for connecting with the joint portion 11, a pad 111 located at one end of the joint portion 11, and a free end portion 13 located at one end of the deforming portion 12.

As illustrated in FIG. 3 to FIG. 5, the manufacturing method of the electroacoustic transducer comprises the following steps:

a first step of positioning the flexible strip 1 after the material of the flexible strip 1 is shaped into a strip-shaped structure, injecting sizing material from a position corresponding to the joint portion 11 of the flexible strip 1 to form the first sub shell 21 so that the flexible strip 1 is bonded to the first sub shell 21 by injection molding, wherein one face of the pad 111 is exposed out of the surface of the first sub shell 21 to be electrically connected to the lead wire of the voice coil of the electroacoustic transducer;

a second step of injection molding the second sub shell 22; and a third step of fixedly integrating the first sub shell 21 with the second sub shell 22, wherein the strip-shaped flexible strip 1 is bent from the bonding surface 212 of the first sub shell 21, i.e., the deforming portion 12 is bent from its one end located at the bonding surface 212 to form the bent portion 121 before the third step, i.e., before or after the second step. In addition, the free end portion 13 is bent to be combined with the shell 2.

In the third step, the first sub shell 21 is bonded to the second sub shell 22 at the bonding surface 212 by gluing, ultrasonic welding, snap-fitting or heat-melting. The magnetic circuit system and the vibrating system are bonded with the shell 2 of the electroacoustic transducer after the shell 2 is assembled with the flexible strips 1.

The shell 2 is comprised of the first sub shell 21 and the second sub shell 22, and the flexible strips 1 are bonded to the first sub shell 21 by injection molding and bent, and then the first sub shell 21 is bonded with the second sub shell 22. With such a design, the positions at which the flexible strips 1 are bent, and the size of the flexible strips 1 can be controlled by controlling the ratio of the size of the first sub shell 21 to that of the second sub shell 22, and the bent portions 121 of the flexible strips 1 are inside the edges 20 of the shell 2, thereby reducing the space occupied by the flexible strips 1, saving the mounting space occupied when the electroacoustic transducer is assembled into a final product, and contributes to the miniaturization of the final product.

With the above teaching of the present invention, other improvements and variants can be made by those skilled in the art based on the above embodiments which fall into the scope of the present invention. It will be understood by those skilled in the art that the above specific description is intended to provide a better understanding of the present invention, and the scope of the present invention is defined by the claims and its equivalents.

The invention claimed is:

1. An electroacoustic transducer comprising a flexible strip and a shell, the flexible strip configured for electrically connecting internal circuitry with external circuitry of the electroacoustic transducer, the electroacoustic transducer is characterized in that:

the shell is ring-shaped and comprises a first sub shell and a second sub shell which are fixedly bonded to each other;

a part of the flexible strip is bonded to the first sub shell by injection molding, the first sub shell is provided with a bonding surface at its one end close to the second sub shell, the bonding surface being bonded to the second sub shell, the flexible strip projects above the bonding surface and is bent at the bonding surface to form a bent portion; and the second sub shell is provided with a dodging structure at a position corresponding to the bent portion, which is used for dodging the bent portion, and the bent portion is inside an edge of the shell.

2. The electroacoustic transducer according to claim 1, characterized in that, the first sub shell and the second sub shell form a step-shaped dodging structure at the bonding surface.

3. The electroacoustic transducer according to claim 2, characterized in that:

the first sub shell is provided with a first end face extending in a horizontal direction at a part close to the bonding surface, the second sub shell is provided with a second end face extending in the horizontal direction at the part close to the bonding surface, and a horizontal plane in which the first end face is located is higher than a horizontal plane in which the second end face is located; and the bent portion is located above the second end face.

4. The electroacoustic transducer according to claim 2, characterized in that, the flexible strip comprises a joint portion, a deforming portion and a free end portion, wherein the joint portion is used for fixedly bonding the flexible strip with the shell, the deforming portion is connected with the joint portion, and the free end portion is located at an end of the deforming portion.

5. The electroacoustic transducer according to claim 4, characterized in that, a pad is provided at an end of the joint portion, and is exposed out of an inner side surface of the shell.

6. A manufacturing method of the electroacoustic transducer according to claim 1, characterized in that, comprising the following steps:

a first step of positioning a strip-shaped flexible strip formed by stamping, and injecting a sizing material from a position where the flexible strip is bonded with the first sub shell to be formed, so as to form the first sub shell;

a second step of injection molding the second sub shell; and a third step of fixedly integrating the first sub shell with the second sub shell to form a ring-shaped shell, wherein the strip-shaped flexible strip is bent to form the bent portion from the bonding surface at the end of the first sub shell before the third step.

7. The manufacturing method of the electroacoustic transducer according to claim 6, characterized in that, the first sub shell and the second sub shell are fixedly bonded at the bonding surface by gluing or ultrasonic welding.

8. The manufacturing method of the electroacoustic transducer according to claim 6, characterized in that, the first sub shell and the second sub shell are fixedly bonded at the bonding surface by snap-fitting or heat-melting.

9. The electroacoustic transducer according to claim 3, characterized in that, the flexible strip comprises a joint portion, a deforming portion and a free end portion, wherein the joint portion is used for fixedly bonding the flexible strip with the shell, the deforming portion is connected with the joint portion, and the free end portion is located at an end of the deforming portion.

10. The electroacoustic transducer according to claim 9, characterized in that, a pad is provided at an end of the joint portion, and is exposed out of an inner side surface of the shell.

11. An electroacoustic transducer comprising a flexible strip and a shell, the flexible strip electrically connecting internal circuitry with external circuitry of the electroacoustic transducer, the electroacoustic transducer is characterized in that:

the shell is ring-shaped and comprises a first sub shell and a second sub shell which are fixedly bonded to each other;

a part of the flexible strip is bonded to the first sub shell, the first sub shell has a bonding surface that is bonded to the second sub shell, the flexible strip projects from the bonding surface and includes a bent portion; and the second sub shell provides a dodging structure to accommodate the bent portion of the flexible strip, and the bent portion is disposed inside an edge of the shell.

12. The electroacoustic transducer according to claim 11, characterized in that, the first sub shell and the second sub shell have a step-shaped dodging structure at the bonding surface.

13. The electroacoustic transducer according to claim 12, characterized in that:

the first sub shell further has a first end face extending in a first direction and being adjacent to the bonding surface, the second sub shell has a second end face extending in the first direction and being adjacent to a portion of the bonding surface, and the first end face is separated from a bottom surface of the shell from a first distance, the second end face is separated from the bottom surface of the shell by a second distance, the first distance is greater than the second distance; and the bent portion is located above the second end face.

14. The electroacoustic transducer according to claim 12, characterized in that, the flexible strip comprises a joint portion, a deforming portion, and a free end portion, wherein the joint portion is fixedly bonded to the shell, the deforming portion is connected with the joint portion, and the free end portion is located at an end portion of the deforming portion.

15. The electroacoustic transducer according to claim 14, characterized in that, a pad is provided at an end portion of the joint portion, and protrudes from an inner side surface of the shell.

16. A manufacturing method of the electroacoustic transducer according to claim 11, characterized in that, the method comprising:

positioning a strip-shaped flexible strip that has been formed by stamping, and injecting a material to form the first sub shell;

after forming the first sub shell, injection molding the second sub shell; and fixedly bonding the first sub shell and the second sub shell to form a ring-shaped shell, wherein the strip-shaped flexible strip is bent to form the bent portion before fixedly bonding the first sub shell and the second sub shell.

17. The manufacturing method of the electroacoustic transducer according to claim 16, characterized in that, the first sub shell and the second sub shell are fixedly bonded at the bonding surface by gluing or ultrasonic welding.

18. The manufacturing method of the electroacoustic transducer according to claim 16, characterized in that, the first sub shell and the second sub shell are fixedly bonded at the bonding surface by snap-fitting or heat-melting.

19. The electroacoustic transducer according to claim 13, characterized in that, the flexible strip comprises a joint portion, a deforming portion and a free end portion, wherein the joint portion is fixedly bonded to the shell, the deforming portion is connected with the joint portion, and the free end portion is located at an end portion of the deforming portion.

20. The electroacoustic transducer according to claim 19, characterized in that, a pad is provided at an end portion of the joint portion, and protrudes from an inner side surface of the shell.

* * * * *